United States Patent [19]

Rifkin et al.

[11] 4,398,921

[45] Aug. 16, 1983

[54] GASOHOL COMPOSITIONS

[75] Inventors: Ellis B. Rifkin, Southfield; Martin E. Gluckstein, Detroit; Warren L. Perilstein, Orchard Lake, all of Mich.

[73] Assignee: Ethyl Corporation, Richmond, Va.

[21] Appl. No.: 317,571

[22] Filed: Nov. 2, 1981

[51] Int. Cl.[3] ..... C10L 1/18

[52] U.S. Cl. ..... 44/56; 44/55; 44/58; 44/70; 44/75; 252/396

[58] Field of Search ..... 44/55, 56, 75, 58, 62, 44/70; 252/396

[56] References Cited

U.S. PATENT DOCUMENTS 2,334,158 11/1943 von Fuchs et al. ..... 44/70

4,116,644 9/1978 Jackisch et al. ..... 44/75

*Primary Examiner*—Charles F. Warren

*Assistant Examiner*—Y. Harris-Smith

*Attorney, Agent, or Firm*—Donald L. Johnson; Joseph D. Odenweller; John F. Hunt

[57] ABSTRACT

Liquid fuels for use in internal combustion engines comprising (i) a major fraction of hydrocarbons boiling in the gasoline boiling range, (ii) a minor amount of ethanol and (iii) a detergent amount of (I) from about 20 to about 40 weight percent of the reaction product of:

(A) one mole part of an alkylphenol having the formula:

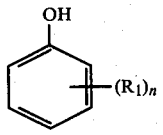

wherein n is an integer from 1 to 2, and $R_1$ is an aliphatic hydrocarbon radical having an average molecular weight of from about 400 to 1500;

(B) from 1–5 mole parts of an aldehyde having the formula:

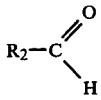

wherein $R_2$ is selected from hydrogen and alkyl radicals containing 1–6 carbon atoms; and (C) from 0.5–5 mole parts of an amine having at least one active hydrogen atom bonded to an amino nitrogen atom, and (II) from about 3.0 to about 6.0 weight percent of a demulsifying agent containing:

(A) at least one oil-soluble polyether characterized by the presence within its structure of a group of the formula:

$(—O-A—)_x$ wherein A is an alkylene group containing from 2 to about 7 carbon atoms and where x has an average value of from about 5 to about 200; and (B) an oxyalkylated phenol formaldehyde resin of the formula:

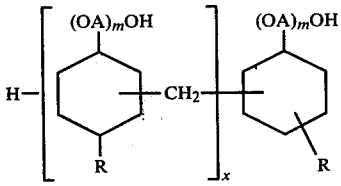

wherein A represents an alkylene group containing from about 2 to about 10 carbon atoms, where m has an average value of from about 4 to about 200, and where R is an alkyl group of from about 1 to about 20 carbon atoms, and x is an integer greater than 1, (III) from about 40 to about 70 weight percent of a mononuclear or dinuclear aromatic hydrocarbon solvent, and (IV) from about 5.0 to about 15.0 weight percent of a corrosion inhibitor selected from a hydrocarbyl succinic acid or anhydride having from 12 to 30 carbon atoms (50% oil).

6 Claims, No Drawings

GASOHOL COMPOSITIONS

BACKGROUND OF THE INVENTION

1. Field of the Invention

This invention relates to novel fuel compositions for use in internal combustion engines. More particularly, this invention relates to gasoline-ethanol fuel mixtures having carburetor detergency properties. The invention also is concerned with a process for conferring carburetor detergency properties to ethanol in gasoline fuel mixtures.

2. Description of the Prior

Worldwide concern over the growing shortages of crude oil supplies has promoted the use of many materials as blending agents in gasoline to extend the fuel supply. From the engine or motor vehicle manufacturers' point of view, it seems easiest to employ alcohol blended with gasoline. Methanol, ethanol and t-butyl alcohol have emerged as the most widely used alcohol blending agents. Recently, a high level of interest has been shown in the use of "Gasohol," defined herein as a blend of gasoline with from about 5 to about 30 volume percent ethanol, as an automotive fuel. Interest has been especially high in countries such as Brazil which have an intense cultivation of sugar cane, mandioca and other raw materials of vegetable origin adequate for the production of ethanol.

The use of a polar oxygenate such as ethanol in gasoline blends, however, has far reaching consequences. One of these is the formation of deposits in the fuel induction system such as the carburetor and around the intake valves. These deposits interfere with the efficient operation of the engine and can lead to lower mileage and increased exhaust emissions. It is believed that deposit formation may be caused by several factors. One of these may be the loosening of rust by the alcohol from the walls in pipelines and storage tanks which is then transported through the system until it finds its way into the fuel induction system of the engine. Another factor may be the presence of trace amounts of acetic acid, acetaldehyde, acetate and n-butanol in the ethanol-gasoline blends which are formed during the production of the alcohol during fermentation. These impurities likewise may ultimately end up in the fuel induction system of the engine and contribute to deposit formation. Other factors which may contribute to deposit formation may be phase separation problems which occur because commercial ethanol (hydrous ethanol) has limited solubility in gasoline and the presence of dissolved mineral salts, such as sodium chloride, which may find their way into the fuel during production, storage and transportation. In fact, applicant has established that heavier carburetor deposits are obtained with the use of gasohol than with gasoline as will be demonstrated below.

Thus, there is presently a need for a fuel induction detergent that will either retard or prevent the formation of deposits in the fuel induction system of an internal combustion engine operated on an ethanol-gasoline fuel mixture. Further, it is important that the detergent be effective in very small quantities to avoid any adverse effects, such as adding to the gum component of the fuel, etc., as well as to minimize cost. The detergent compositions of the present invention satisfy these needs.

It is known in the art that the inclusion in gasoline of the condensation product of a high molecular weight alkylphenol, an aldehyde and an amine having an H—N> group, as well as concentrates containing in addition to the condensation product other components such as demulsifying agents, solvents, corrosion inhibitors and the like, improve intake system cleanliness. Illustrative patents include U.S. Pat. Nos. 3,649,229; 3,752,657; 3,994,698; 4,116,644; Austrian Pat. No. 315,994; British Pat. No. 1,368,532 and German Pat. No. 2,209,579.

It is generally appreciated, however, by those skilled in the art that the blending of components to make a suitable concentrate to be used in gasoline compositions is very difficult. The components must not only be used in amounts which confer the required properties on the gasoline concentrate, but the components must also be compatible with each other under use and storage conditions. Furthermore, some components used for different functions can be found to be mutually antagonistic such as mixtures of corrosion inhibitors and demulsifiers. When antagonism occurs, loss of desired function is a result.

Given the acknowledged difficulties in selecting specific components to make an effective detergency concentrate for use in gasoline, it was quite surprising to discover that a Mannich base concentrate, such as the concentrate of the present invention, would function effectively as a fuel induction detergent in engines operated on gasoline-alcohol fuel mixtures, such as gasohol defined hereinabove.

SUMMARY OF THE INVENTION

This invention is a fuel comprising a major amount of gasoline, a minor amount of ethanol and a detergent amount of:

(I) from about 20 to about 40 weight percent of the reaction product of:

(A) one mole part of an alkylphenol having the formula:

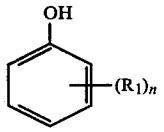

wherein n is an integer from 1 to 2, and $R_1$ is an aliphatic hydrocarbon radical having an average molecular weight of from about 400 to 1500;

(B) from 1–5 mole parts of an aldehyde having the formula:

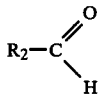

wherein $R_2$ is selected from hydrogen and alkyl radicals containing 1–6 carbon atoms; and (C) from 0.5–5 mole parts of an amine having at least one active hydrogen atom bonded to an amino nitrogen atom, and (II) from about 3.0 to about 6.0 weight percent of a demulsifying agent containing:

(A) at least one oil-soluble polyether characterized by the presence within its structure of a group of the formula:

$(-O-A-)_x$ wherein A is an alkylene group containing from 2 to about 7 carbon atoms and where x has an average value of from about 5 to about 200; and (B) an oxyalkylated phenol formaldehyde resin of the formula:

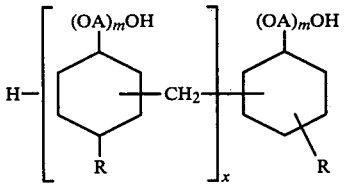

wherein A represents an alkylene group containing from about 2 to about 10 carbon atoms, where m has an average value of from about 4 to about 200, and where R is an alkyl group from about 1 to about 20 carbon atoms, and x is an integer greater than 1, (III) from about 40 to about 70 weight percent of a mononuclear or dinuclear aromatic hydrocarbon solvent, and (IV) from about 5.0 to about 15.0 weight percent of a corrosion inhibitor selected from a hydrocarbyl succinic acid or anhydride having from 12 to 30 carbon atoms (50% in oil).

In accordance with the present invention, from about 1.0 to about 100 ppm of the detergent additive is blended with a fuel consisting of from about 70 to about 95 volume percent gasoline and from about 5 to about 30 volume percent ethanol.

The invention is generally applicable to hydrocarbon mixtures in the gasoline boiling range of about 80° F. to about 430° F. These mixtures are obtained by separating an appropriate boiling fraction from a hydrocarbon distillate obtained in the refining of crude oil.

Processwise, the invention resides in blending, using suitable mixing equipment, gasoline, ethanol and the detergent additive in the above given proportions.

As shown below, the addition of the Mannich product additives of the present invention to ethanol-gasoline fuel mixtures imparts detergent properties to the fuel mixture.

DESCRIPTION OF THE PREFERRED EMBODIMENTS

Thus, a preferred embodiment of the present invention is a liquid fuel for use in internal combustion engines comprising a major amount of hydrocarbons boiling in the gasoline boiling range, a minor amount of ethanol and a detergent amount of:

(1) from about 20 to about 40 weight percent of the reaction product of:

(A) one mole part of an alkylphenol having the formula:

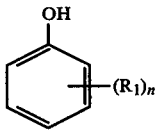

wherein n is an integer from 1 to 2, and $R_1$ is an aliphatic hydrocarbon radical having an average molecular weight of from about 400 to 1500;

(B) from 1-5 mole parts of an aldehyde having the formula:

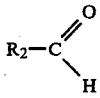

wherein $R_2$ is selected from hydrogen and alkyl radicals containing 1-6 carbon atoms; and (C) from 0.5-5 mole parts of an amine having at least one active hydrogen atom bonded to an amino nitrogen atom, and (II) from about 3.0 to about 6.0 weight percent of a demulsifying agent containing:

(A) at least one oil-soluble polyether characterized by the presence within its structure of a group of the formula:

$(-O-A-)_x$ wherein A is an alkylene group containing from 2 to about 7 carbon atoms and where x has an average value of from about 5 to about 200; and (B) an oxyalkylated phenol formaldehyde resin of the formula:

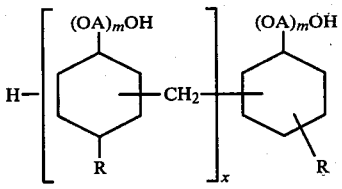

wherein A represents an alkylene group containing from about 2 to about 10 carbon atoms, where m has an average value of from about 4 to about 200, and where R is an alkyl group of from about 1 to about 20 carbon atoms, and x is an integer greater than 1, (III) from about 40 to about 70 weight percent of a mononuclear or dinuclear aromatic hydocarbon solvent, and (IV) from about 5.0 to about 15.0 weight percent of a corrosion inhibitor selected from a hydrocarbyl succinic acid or anhydride having from 12 to 30 carbon atoms (50% oil).

Another embodiment of the present invention is a process for conferring anti-corrosion properties to ethanol in gasoline fuel mixtures which comprises adding to a fuel comprising a major amount of hydrocarbons boiling in the gasoline boiling range and a minor amount of ethanol a detergent amount of:

(I) from about 20 to about 40 weight percent of the reaction product of:

(A) one mole part of an alkylphenol having the formula:

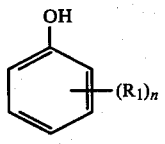

wherein n is an integer from 1 to 2, and $R_1$ is an aliphatic hydrocarbon radical having an average molecular weight of from about 400 to 1500;

(B) from 1–5 mole parts of an aldehyde having the formula:

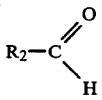

wherein $R_2$ is selected from hydrogen and alkyl radicals containing 1–6 carbon atoms; and (C) from 0.5–5 mole parts of an amine having at least one active hydrogen atom bonded to an amino nitrogen atom, and (II) from about 3.0 to about 6.0 weight percent of a demulsifying agent containing:

(A) at least one oil-soluble polyether characterized by the presence within its structure of a group of the formula:

$(—O—A—)_x$ wherein A is an alkylene group containing from 2 to about 7 carbon atoms and where x has an average value of from about 5 to about 200; and (B) an oxyalkylated phenol formaldehyde resin of the formula:

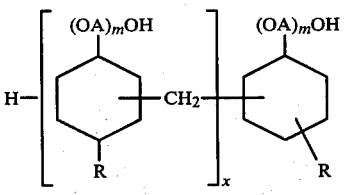

wherein A represents an alkylene group containing from about 2 to about 10 carbon atoms, where m has an average value of from about 4 to about 200, and where R is an alkyl group from about 1 to about 20 carbon atoms, and x is an integer greater than 1, (III) from about 40 to about 70 weight percent of a mononuclear or dinuclear aromatic hydrocarbon solvent, and (IV) from about 5.0 to about 15.0 weight percent of a corrosion inhibitor selected from a hydrocarbyl succinic acid or anhydride having from 12 to 30 carbon atoms (50% in oil).

The detergent component of the present invention is made by condensing a phenol and preferably a high molecular weight alkylphenol, an aldehyde and ammonia or preferably an aliphatic amine having at least one reactive hydrogen atom bonded to nitrogen. In other words, an amine having at least one H—N> group. This reaction is the well-known Mannich reaction (see "Organic Reactions," Volume I). The conditions for carrying out such a condensation are well known.

The preferred alkylphenol reactant is an alkylphenol wherein the alkyl radical has an average molecular weight of from about 400 to 1500. In a more preferred alkylphenol reactant the alkyl radical has an average molecular weight of from about 800 to 1300, and in the most preferred alkyl phenols the alkyl radical has an average molecular weight of from about 900 to 1100.

Alkylphenols suitable for use in the preparation of the present dispersants are readily prepared by adaptation of methods well known in the art. For example, they may be prepared by the acid catalyzed alkylation of phenol with an olefin. In this method, a small amount of an acid catalyst such as sulfuric or phosphoric acid, or preferably a Lewis acid such as $BF_3$-etherate, $BF_3$-phenate complex or $AlCl_2$—$HSO_4$, is added to the phenol and the olefin then added to the phenol at temperatures ranging from about 0° C. up to 200° C. A preferred temperature range for this alkylation is from about 25° C. to 150° C., and the most preferred range is from about 50° C. to 100° C. The alkylation is readily carried out at atmospheric pressures, but if higher temperatures are employed the alkylation may be carried out at super atmospheric pressures up to about 1000 psig.

The alkylation of phenols produces a mixture of mono-, di- and tri-alkylated phenols. Although the preferred reactants are the mono-alkylated phenols, the alkylation mixture can be used without removing the higher alkylation products. The alkylation mixture formed by alkylating phenol with an olefin using an acid catalyst can be merely water washed to remove the unalkylated phenol and the acid catalyst and then used in the condensation reaction without removing the di- and tri-alkylated phenol products. The di-alkylated phenol enters into the condensation reaction and yields useful gasohol detergents. Another method of removing the unreacted phenol is to distill it out, preferably using steam distillation or under vacuum, after washing out the alkylation catalyst. The amount of di- and tri-alkylated phenols can be kept at a minimum by restricting the amount of olefin reactant added to the phenol. Good results are obtained when the mole ratio of olefin to phenol is about 0.25 moles of olefin per mole of phenol to 1.0 mole of olefin per mole of phenol. A more preferred ratio is from about 0.33 to 0.9, and most preferred ratio is from about 0.5 to 0.67 moles of olefin per mole of phenol.

The olefin reactant used to alkylate the phenol is preferably a monoolefin with an average molecular weight of from about 400 to 1500. The most preferred olefins are those formed from the polymerization of low molecular weight olefins containing from about 2 to 10 carbon atoms, such as ethylene, propylene, butylene, pentene and decene. These results in polyalkene substituted phenols. A most preferred olefin is that made by the polymerization of propylene or butene to produce a polypropylene or polybutene mixture with an average molecular weight of from about 900–1100. This gives the highly preferred polypropylene and polybutene substituted phenols.

The aldehyde reactant preferably contains from 1 to 7 carbon atoms. Examples are formaldehyde, acetaldehyde, propionaldehyde, butyraldehyde, valeraldehyde, hexaldehyde and heptaldehyde. The more preferred aldehyde reactants are the low molecular weight aliphatic aldehydes containing from 1 to about 4 carbon atoms such as formaldehyde, acetaldehyde, butyraldehyde and isobutyraldehyde. The most preferred aldehyde reactant is formaldehyde, which may be used in its monomeric or its polymeric form such as paraformaldehyde.

The amine reactants include those that contain at least one active hydrogen atom bonded to an amino nitrogen atom, such that they can partake in a Mannich condensation. They may be primary amines, secondary amines or may contain both primary and secondary amino groups. Examples include the primary alkyl amines such as methyl amine, ethyl amine, n-propyl amine, isopropyl amine, n-butyl amine, isobutyl amine, 2-ethylhexyl amine, dodecyl amine, stearyl amine, eicosyl amine, triacontyl amine, pentacontyl amine, and the like, including those in which the alkyl group contains from 1 to about 50 carbon atoms. Also, dialkyl amines may be used such as dimethyl amine, diethyl amine, methylethyl amine, methylbutyl amine, di-n-hexyl amine, methyl dodecyl amine, dieicosyl amine, methyl triacontyl amine, dipentacontyl amine, and the like, including mixtures thereof.

Another useful class is the N-substituted compounds such as the N-alkyl imidazolidines and pyrimidines. Also, aromatic amines having a reactive hydrogen atom attached to nitrogen can be used. These include aniline, N-methyl aniline, ortho, meta and para phenylene diamines, α-naphthyl amine, N-isopropyl phenylene diamine, and the like. Secondary heterocyclic amines are likewise useful including morpholine, thiomorpholine, pyrrole, pyrroline, pyrrolidine, indole, pyrazole, pyrazoline, pyrazolidine, imidazole, imidazoline, imidazolidine, piperidine, phenoxazine, phenathiazine, and mixtures thereof, including their substituted homologs in which the substituent groups include alkyl, aryl, alkaryl, aralkyl, cycloalkyl, and the like.

A preferred class of amine reactants is the diamines represented by the formula:

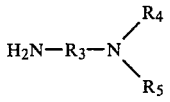

wherein $R_3$ is a divalent alkylene radical containing 1–6 carbon atoms, and $R_4$ and $R_5$ are selected from the group consisting of alkyl radicals containing from 1–6 carbon atoms and radicals having the formula:

$$-R_6-X$$

wherein $R_6$ is a divalent alkylene radical containing from 1–6 carbon atoms, and X is selected from the group consisting of the hydroxyl radical and the amine radical.

The term "divalent alkylene radical" as used herein means a divalent saturated aliphatic hydrocarbon radical having the empirical formula:

$$-C_nH_{2n}-$$

wherein n is an integer from 1 to about 6. Preferably, $R_3$ is a lower alkylene radical such as the $-C_2H_4-$, $-C_3H_6-$, or $-C_4H_6-$ groups. The two amine groups may be bonded to the same or different carbon atoms. Some examples of diamine reactants wherein the amine groups are attached to the same carbon atoms of the alkylene radical $R_3$ are N,N-dialkyl-methylenediamine, N,N-dialkanol-1,3-ethanediamine, and N,N-di(aminoalkyl)-2,2-propanediamine.

Some examples of diamine reactants in which the amine groups are bonded to adjacent carbon atoms of the $R_3$ alkylene radical are N,N-dialkyl-1,2-ethanediamine, N,N-dialkanol-1,2-propanediamine, N,N-di(aminoalkyl)-2,3-butanediamine, and N,N-dialkyl-2,3-(4-methylpentane) diamine.

Some examples of diamine reactants in which the amine groups are bonded to carbon atoms on the alkylene radical represented by $R_3$ which are removed from each other by one or more intervening carbon atoms are N,N-dialkyl-1,3-propanediamine, N,N-dialkanol-1,3-butanediamine, N,N-di(aminoalkyl)-1,4-butanediamine, and N,N-dialkyl-1,3-hexanediamine.

As previously stated, $R_4$ and $R_5$ are alkyl radicals containing 1 to 6 carbon atoms or alkyl radicals containing 1 to 6 carbon atoms which are substituted with the hydroxyl or amine radical. Some examples of hydroxyl substituted radicals are 2-hydroxy-n-propyl, 2-hydroxyethyl, 2-hydroxy-n-hexyl, 3-hydroxy-n-propyl, 4-hydroxy-3-ethyl-n-butyl, and the like. Some examples of amine substituted $R_4$ and $R_5$ radicals are 2-aminoethyl, 2-amino-n-propyl, 4-amino-n-butyl, 4-amino-3,3-dimethyl-n-butyl, 6-amino-n-hexyl, and the like. Preferred $R_4$ and $R_5$ radicals are unsubstituted alkyl radicals such as methyl, ethyl, n-propyl, isopropyl, sec-butyl, n-amyl, n-hexyl, 2-methyl-n-pentyl, and the like. The most preferred $R_4$ and $R_5$ substituents are methyl radicals.

Some specific examples of diamine reactants are N,N-dimethyl-1,3-propanediamine, N,N-dibutyl-1,3-propanediamine, N,N-dihexyl-1,3-propanediamine, N,N-dimethyl-1,2-propanediamine, N,N-dimethyl-1,1-propanediamine, N,N-dimethyl-1,3-hexanediamine, N,N-dimentyl-1,3-butanediamine, N,N-di(2-hydroxyethyl)-1,3-propanediamine, N,N-di(2-hydroxybutyl)-1,3-propanedimaine, N,N-di-(6-hydroxyhexyl)-1,1-hexanediamine, N,N-di(2-aminoethyl)-1,3-propanediamine, N,N-di(2-amino-hexyl)-1,2-butanediamine, N,N-di(4-amino-3,3-di-methyl-n-butyl)-4-methyl-1,3-pentanediamine, and N-(2-hydroxyethyl)-N-(2-aminoethyl)-1,3-propanediamine.

Another very useful class of amine reactants is the alkylene polyamines which have the formula:

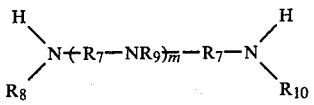

wherein $R_8$, $R_9$ and $R_{10}$ are selected from hydrogen and lower alkyl radicals containing 1–4 carbon atoms, and $R_7$ is a divalent saturated aliphatic hydrocarbon radical containing from 2 to about 4 carbon atoms and m is an integer from 0 to about 4. Examples of these are ethylene diamine, diethylene triamine, propylene diamine, dipropylene triamine, tripropylene tetraamine, tetrapropylene pentamine, butylene diamine, dibutylene triamine, disobutylene triamine, tributylene tetramine, and the like, including the N-$C_{1-4}$ alkyl-substituted homologs.

A most preferred class of amine reactants is the ethylene polyamines. These are described in detail in Kirk-Othmer, "Encyclopedia of Chemical Technology," Vol. 5, pages 898–9, Interscience Publishers, Inc., New York. These include the series ethylene diamine, diethylene triamine, triethylene tetramine, tetraethylene pentamine, pentaethylene hexamine, and the like. A particularly preferred embodiment is a gasoline-ethanol fuel mixture containing the detergent as described herein in which the amine reactant is a mixture of ethylene polyamines containing a substantial amount of triethylene tetramine and tetraethylene pentamine.

The condensation products are easily prepared by mixing together the alkylphenol, the aldehyde reactant and the amine reactant, and heating them to a temperature sufficient to cause the reaction to occur. The reaction may be carried out without any solvent, but the use of a solvent is usually preferred. Preferred solvents are the water immiscible solvents including water-insoluble alcohols (e.g., amyl alcohol) and hydrocarbons. The more preferred water-immiscible solvents are hydrocarbon solvents boiling from 50° C. to about 100° C. Highly preferred solvents are the aromatic hydrocarbon solvents such as benzene, toluene, xylene, and the like. Of these, the most preferred solvent is toluene. The amount of solvent employed is not critical. Good results are obtained when from one to about 50 percent of the reaction mass is solvent. A more preferred quantity is from 3 to about 25 percent, and a most preferred quantity of solvent is from about 5 to 10 percent.

The ratio of reactants per mole of alkylphenol can vary from about 1 to 5 moles of aldehyde reactant and 0.5–5 moles of amine reactant. Molar amounts of amine less than one can be used when the amine contains more than one H-N>group, such as in the ethylene polyamines (e.g., tetraethylenepentamine). A more preferred reactant ratio based on one mole of alkylphenol is from 2.5 to 4 moles of aldehyde and from 1.5 to 2.5 moles of amine reactant. A most preferred ratio of reactants is about 2 moles of alkylphenol to about 3 moles of aldehyde to about 2 moles of amine reactant. This ratio gives an especially useful product when the alkylphenol is a polybutene-substituted phenol in which the polybutene group has a molecular weight of about 900–1100, the aldehyde is formaldehyde and the amine is N,N-dimethyl-1,3-propanediamine.

The condensation reaction will occur by simply warming the reactant mixture to a temperature sufficient to effect the reaction. The reaction will proceed at temperatures ranging from about 50° C. to 200° C. A more preferred temperature range is from about 75° C. to 175° C. When a solvent is employed it is desirable to conduct the reaction at the reflux temperature of the solvent-containing reaction mass. For example, when toluene is used as the solvent, the condensation proceeds at about 100° C. to 150° C. as the water formed in the reaction is removed. The water formed in the reaction co-distills together with the water-immiscible solvent, permitting its removal from the reaction zone. During this water removal portion of the reaction period the water-immiscible solvent is returned to the reaction zone after separating water from it.

The time required to complete the reaction depends upon the reactants employed and the reaction temperature used. Under most conditions the reaction is complete in from about 1 to 8 hours.

The reaction product is a viscous oil and is usually diluted with a neutral oil to aid in handling. A particularly useful mixture is about two-thirds condensation product and one-third neutral oil.

It has been found that the use of the aforedescribed condensation product presents certain problems when the condensation product is used with water intolerant fuels, i.e., fuels which when contacted with water tend to degrade or form an emulsion. This problem is found in gasoline-ethanol fuel mixtures when commercial ethanol is used because the water containing ethanol has limited solubility in gasoline.

It has been found that a specific two component demulsifying composition, when used in combination with the condensation product solves these gasoline-water emulsion problems. The first essential component of the demulsifying composition is a polyether. By polyether is meant that class of oil-soluble materials characterized by the presence within their structure of at least one group of the formula $—O—A)_x$ wherein A is an alkylene group, said alkylene group being a straight or branched chain alkylene group containing from 2 to 7 carbon atoms, and wherein x has an average value of from about 5 and up to about 200. Such polyethers are generally prepared by reacting an active hydrogen containing compound such as alcohols, amines, phenols, phenolformaldehyde condensation products, carboxylic acids, carboxylic acid esters, and the like with one or more alkylene oxides. The alkylene oxides are of the general formula

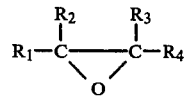

wherein $R_1$, $R_2$, $R_3$, and $R_4$ are each independently hydrogen, alkyl cycloalkyl, alkenyl, aryl, and aralkyl groups. These hydrocarbon groups may contain such substituents as halo, nitro, alkoxy, and the like. The total number of carbon atoms in the alkylene oxide should not exceed 10 and should preferably be 2 to 4. Some non-limiting examples of these alkylene oxides are ethylene oxide, propylene oxide, 1,3-butylene oxide, epichlorohydrin, 1,2-octylene oxide, styrene oxide, and the like.

The preferred polyethers are polyoxalkylene polyols and derivatives thereof. In addition to the polyols, the esters thereof obtained by reacting the polyols with various carboxylic acids are also suitable as the polyether component of the additive combination. Acids useful in preparing these esters are lauric acid, stearic acid, succinic acid, and the like.

The most preferred polyethers are the glycols of the general formula $H(OA)_nOH$ wherein (OA) represents mixed oxides, and A represents an alkylene group, said alkylene group being a straight or branched chain alkylene group containing from 2 to about 7 carbon atoms, and wherein n has an average value of from about 5 to about 200.

One class of particularly useful liquid glycols have the general formula:

$$HO—(CH_2CH_2O)_x(\underset{\underset{CH_3}{|}}{C}HCH_2O)_y(CH_2CH_2O)_z—H$$

wherein x, y, and z are integers greater than one such that the $CH_2CH_2O$ groups comprise from about 10 percent to about 40 percent by weight of the polyether, the average molecule weight of said polyether being from about 1000 to about 5000.

Polyglycols are known as fuel additives. For example, U.S. Pat. No. 2,807,525 discloses polyglycol in gasoline to reduce gum deposits.

U.S. Pat. No. 2,965,678 discloses their use for demulsifying petroleum emulsions.

The second essential component of the demulsifier composition is an oxalkylated phenol formaldehyde resin of the formula:

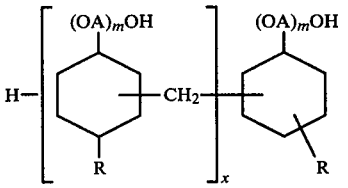

wherein (OA) in general represents mixed oxides and A represents an alkylene group, said alkylene group being either a straight or branched chain alkylene group containing from about 2 to about 10 carbon atoms; m has an average value of from about 4 up to about 200, and R is an alkyl or mixed alkyl group of from one to about 20 carbon atoms, and x is an integer greater than 1. The use of oxyalkylated phenol formaldehyde resin as a demulsifier in petroleum water-in-oil emulsions is disclosed in U.S. Pat. No. 2,499,370.

In general, to form the demulsifying composition of the present invention, the above 2 components, i.e., polyglycol and oxyalkylated phenol formaldehyde resin are mixed together in suitable ratio, usually in the presence of an inert organic diluent. One such composition which is especially preferred for use in the present concentrate is commercially available from the Treatolite Division of the Petrolite Corporation, 369 Marshall Avenue, St. Louis, Missouri and is known to the trade as Tolad 331.

It has been found that upon adding the detergent composition of the present invention, i.e., the phenol/aldehyde/amine product, to the demulsifying composition, these two compositions are not entirely compatible in that upon standing a sludge tends to develop. This problem of sludge formation can be rectified by the addition to the detergent/demulsifier composition of certain organic solvents described below.

Useful organic solvents are the aromatic hydrocarbons. The preferred aromatic hydrocarbons are the mononuclear or polynuclear aromatics such as the benzenes and naphthalenes. The more preferred aromatic hydrocarbons are the alkyl substituted aromatics. The most preferred aromatics are the lower alkyl substituted naphthalenes and benzenes such as xylene, toluene, 1,3,3-trimethylbenzene, 1,2,4-trimethylbenzene 1,2,3-trimethylbenzene, 1,3,5-triethylbenzene, 1,2,4-triethylbenzene, 1-ethyl-2-methylbenzene, 1-ethyl-3-methylbenzene, 1-ethyl-4-methylbenzene, pentamethylbenzene and the like. The aromatic solvent may be individual aromatic hydrocarbons or mixtures of such aromatic hydrocarbons.

The detergent compositions of the present invention also contain specified corrosion inhibitors. These corrosion inhibitors which have been found to be particularly effective in the concentrates of the present invention i.e., compatible with the aforedescribed components of the present concentrates, and hydrocarbyl succinic acids or anhydrides having from 12 to 30 carbon atoms. The hydrocarbyl-substituted succinic acid or anhydride may be prepared by the reaction of an olefin with maleic acid or maleic anhydride. For example, an alpha-olefin, such as those obtained from cracking wax (cracked wax olefins), is reacted with maleic anhydride or maleic acid to form an alkenyl succinic acid or anhydride. This product may then be hydrogenated to form the alkyl succinic anhydride or acid. However, in most instances there will be little advantage, if any, in the alkyl over the alkenyl succinic acid or anhydride. The methods of reacting an olefin with maleic anhydride are well known in the art and do not require exemplification here. Illustrative of various alpha-olefins which may find use are 1-dodecene, 1-tridecene, 1-tetradecene, 1-pentadecene.

When the addition reaction with maleic anhydride is utilized, or otherwise, it is often desirable to use as the olefinic hydrocarbon reactant a low molecular weight polymer of a $C_2$ to $C_4$ olefin (i.e., an oligomer of $C_2$ to $C_4$ olefin). Such oligomers are represented by tetrapropylene, triisobutylene, tetraisobutylene, etc. Such oligomers are mono-olefins of a straight or branched chain structure.

A particularly prefered method in preparing the reaction product of this invention is the addition of the oligomer tetrapropylene to maleic acid anhydride or acid. The most preferred hydrocarbyl succinic acid component of this invention is tetrapropenyl succinic acid. In U.S. Pat. No. 2,334,158 there is disclosed the use of an alkylated succinic acid containing at least 16 carbon atoms in gasoline as a rust inhibitor. In U.S. Pat. No. 3,447,918 there is disclosed the use of a polybutene substituted succinic acid as a rust inhibitor in distillate fuel.

Thus, a preferred detergent composition contains, besides the aforedescribed corrosion inhibitor, (1) phenol/aldehyde/amine reaction product, (2) the two component demulsifier, and (3) aromatic hydrocarbon solvent.

A useful detergent composition contains, by weight percent, from about 20 percent to about 40 percent of the phenol/aldehyde/amine condensation product, from about 3.0 percent to about 6.0 percent of the demulsifying agent, from about 40 percent to about 70 percent of the aromatic hydrocarbon and from about 5.0 percent to about 15 percent of the corrosion inhibitor.

Another preferred detergent composition contains by weight percent, about 37 percent of the phenol/aldehyde/amine condensation product, about 5.4 percent of the demulsifying agent, about 50.7 percent of the aromatic hydrocarbon and about 7.3 percent of the corrosion inhibitor, preferably tetrapropenyl succinic acid (50% in oil).

Another preferred detergent composition contains by weight percent, about 25 percent of the phenol-aldehyde/amine condensation product, about 3.6 percent of the demulsifying agent, about 62.3 percent of the aromatic hydrocarbon and about 9.7 percent of the corrosion inhibitor, preferably tetrapropenyl succinic acid (50% in oil).

The hydrocarbon fuel component of the ethanol-hydrocarbon fuel mixtures into which the additive compositions of this invention are incorporated to confer detergency properties to the fuel mixtures are liquid hydrocarbon fuels boiling in the range of about 80° F. to about 430° F. and include motor gasolines, aviation gasolines, jet fuels, kerosenes, diesel fuels and fuel oils. The ethanol-hydrocarbon fuel compositions containing the rust inhibiting compounds of this invention may also contain conventional additives such as antiknock compounds, antioxidants, metal deactivators, antistatic agents, anti-icing agents, detergents, dispersants, thermal stabilizers, dyes and the like.

The ethanol blending agent component of the present fuel mixtures can be either anhydrous or hydrous ethanol. That is, either 200 proof ethanol or hydrous (or "wet") ethanol containing up to about 5.0 volume percent water can be blended with the hydrocarbon and detergent compositions of the fuel mixtures of this invention. The amount of ethanol which can be present in the fuel mixtures of the present invention can range from about 5 to about 30 percent by volume.

While the foregoing disclosure has thus far illustrated the invention mainly by reference to the use of ethanol as the alcohol blending agent or component of the fuel mixture, it is to be understood that ethanol can be replaced in the present fuel mixtures with other suitable alcohol blending agents such as methanol, propanol, n-butanol, isobutanol and t-butyl alcohol in approximately the same amounts by volume as ethanol.

As set forth above, from about 1.0 to about 100 ppm, and preferably from about 5 to 50 ppm, of the detergent additive compositions of the present invention are blended with the ethanol containing hydrocarbon fuel mixtures.

The detergent compositions of the present invention can be added to the ethanol containing gasoline fuel mixtures disclosed herein by any means known in the art for incorporating small quantities of additives into conventional hydrocarbon fuels. In general, effective amounts of the multi-component compositions are simply added to and blended with the ethanol-containing hydrocarbon fuels.

Obviously, many modifications and variations of the invention hereinbefore set forth may be made without departing from the spirit and scope thereof and therefore only such limitations should be imposed thereon as are indicated in the appended claims.

The following examples illustrate the invention.

EXAMPLE I

Carburetor Detergency Tests

Tests were conducted to demonstrate the effectiveness of the present compositions in conferring detergency properties to ethanol-gasoline fuel blends. These tests show the fuels to be effective in cleaning carburetors.

Carburetor detergency tests were conducted in accordance with the CRC tentative research technique for the study of carburetor cleanliness characteristics of gasoline. The CRC carburetor detergency stay-clean test is the result of an industry-wide cooperative effort to develop a standard procedure to provide a method for investigating and studying the ability of gasolines to keep clean the throttle body area of carburetors. Deposits, induced by blow-by contamination of the intake air, EGR and by the particular type of engine operating conditions selected, tend to form in the throttle body area. These deposits can affect the idle and low-speed metering characteristics of the carburetor and thus influence exhaust emissions, fuel consumption and performance. This technique measures the effect of keep-clean characteristics of gasoline by determining the amount of deposits formed on a removable carburetor throttle body sleeve. The technique involves operating a 6-cylinder 240 CID engine under cycling conditions of idle and medium speed for a total of 20 hours. A controlled amount of blowby induced by enlarging the gaps of the compression rings, is passed into the top of the carburetor. Also full EGR is applied during the cruise condition. Performance of the test gasoline is judged by the amount of deposits formed on the removable throttle body sleeve as determined by weight and visual rating. The CRC tests were conducted using (1) unleaded gasoline; (2) gasohol comprising 90 volume percent unleaded gasoline and 10 volume percent denatured ethanol; and (3) gasohol comprising 90 volume percent unleaded gasoline, 10 volume percent denatured ethanol and 25 PTB (lb/1000bbl) of a detergent additive comprising approximately 36.6 weight percent of the reaction product of (A) one mole part of an alkylphenol having the formula:

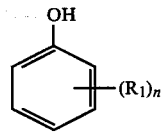

wherein n is an interger from 1 to 2, and $R_1$ is an aliphatic hydrocarbon radical having an average molecular weight of from about 400 to 1500;

(B) from 1–5 mole parts of an aldehyde having the formula:

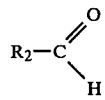

wherein $R_2$ is selected from hydrogen and alkyl radicals containing 1–6 carbon atoms; and (C) from 0.5–5 moles of an amine having at least one active hydrogen atom bonded to an amino nitrogen atom; and about 5.4 weight percent of a demulsifying agent containing:

(A) at least one oil-soluble polyether characterized by the presence within its structure of a group of the formula:

$$(-O-A-)_x$$

wherein A is an alkylene group containing from 2 to about 7 carbon atoms and where x has an average value of from about 5 to about 200; and (B) an oxyalkylated phenol formaldehyde resin of the formula:

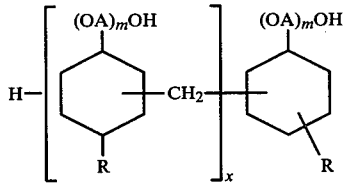

wherein A represents an alkylene group containing from about 2 to about 10 carbon atoms, where m has an average value of from about 4 to about 200, and where R is an alkyl group of from about 1 to about 20 carbon atoms, and x is an integer greater than 1;

about 50.7 weight percent of a mixture of mononuclear and dinuclear aromatic hydrocarbon solvent, and; about 7.3 weight percent tetrapropenyl succinic acid (50% in oil).

The gasoline portion of these fuel blends had the following specifications:

| | |
|---|---|
| ASTM D-86 Distillation | °F. |
| Initial Boiling Point | 86 |
| 5% | 105 |
| 10% | 119 |
| 15% | 129 |
| 20% | 140 |
| 30% | 163 |
| 40% | 198 |
| 50% | 225 |
| 60% | 238 |
| 70% | 249 |
| 80% | 267 |
| 85% | 284 |
| 90% | 308 |
| 95% | 347 |
| Final | 411 |
| Recovery | 97.5 ml. |
| Residue | 0.4 ml. |
| Loss | 2.1 ml. |
| ASTM D-323 Reed Vapor Pressure (lbs) | 8.29 |
| ASTM D-525 Oxidation Stabilization | 1440 + min. |
| Lead Content | 0.003 g/gal |
| Mn Content | 0.001 g/gal |
| Gravity (D-287) °API | 53.3 |
| ASTM D-1319 Hydrocarbon Types | |
| Saturates Vol. % | 44.0 |
| Olefins Vol. % | 13.0 |
| Aromatics Vol. % | 43.0 |

The ethanol portion of the fuel blends was anhydrous ethanol, designated Union Carbide Synasol Solvent, and was obtained commercially from the Union Carbide Co. It was prepared from 100 gallons of anhydrous specially denatured No. 1 ethanol (100 gallons of ethanol denatured with 5 gallons of methanol) denatured with 1 gallon of methyl isobutyl ketone, 1 gallon ethyl acetate, (87–89%), and 1 gallon aviation gasoline.

The test fuels were prepared simply by blending the unleaded gasoline and ethanol portions of the fuel together in a ratio of 90 volume percent gasoline and 10 volume percent ethanol. The additive composition was then blended with the fuel mixture in an amount equal to 25 PTB.

The results of the test are shown in Table 1 below.

TABLE 1

| 20 Hour CRC Detergency Tests | Carburetor Deposits, gm. |
|---|---|
| Base Gasoline | 49 |
| Gasohol (90% Base + 10% alcohol) | 86 |
| Gasohol + 25 PTB Additive | 49 |

As demonstrated in the table, heavier carburetor deposits were obtained with gasohol than with base gasoline in the tests. Gasohol gave almost twice the carburetor deposits as gasoline alone, however, the addition of 25 PTB of the additive to the gasohol brought the gasohol deposit back to baseline level.

In another preferred embodiment a synthetic olefin oligomer is used with the condensation product. These oligomers are prepared by the polymerization of aliphatic monoolefinic hydrocarbons such as ethylene, propylene, butene, decene-1, and the like. These result in such adjuvants as polyethylene, polypropylene, polybutene, α-decene trimer, α-decene tetramer and mixtures of the proper average molecular weight.

A particularly preferred polyolefin adjuvant is polybutene. Means of carrying out the polymerization of the simple olefin monomers are well known.

The polymerization should be carried out until the olefin forms a normally liquid oligomer having an average molecular weight of from about 300 to 2,000, especially 350–1500. The oligomers of this molecular weight range have the greatest effect in promoting the cleaning of intake valves when used in combination with a detergent of this invention. Additional polyolefins that may be used in the present invention and methods for their preparation are set forth in U.S. Pat. No. 3,948,619 Worrell, incorporated herein by reference, beginning at column 11, line 23 and continuing through column 19, line 17.

We claim:

1. A liquid fuel for use in internal combustion engines comprising from about 70 to about 90 volume percent hydrocarbons boiling in the gasoline boiling range, from about 5 to about 30 volume percent ethanol and a detergent amount of an additive comprising:

(I) from about 20 to about 40 weight percent of the reaction product of:

(A) one mole part of an alkylphenol having the formula:

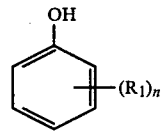

wherein n is an integer from 1 to 2, and $R_1$ is an aliphatic hydrocarbon radical having an average molecular weight of from about 400 to 1500;

(B) from 1–5 mole parts of an aldehyde having the formula:

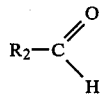

wherein $R_2$ is selected from hydrogen and alkyl radicals containing 1–6 carbon atoms; and (C) from 0.5–5 mole parts of an amine having at least one active hydrogen atom bonded to an amino nitrogen atom, and (II) from about 3.0 to about 6.0 weight percent of a demulsifying agent containing:

(A) at least one oil-soluble polyether characterized by the presence within its structure of a group of the formula:

$$(-O-A-)_x$$

wherein A is an alkylene group containing from 2 to about 7 carbon atoms and where x has an average value of from about 5 to about 200; and (B) an oxyalkylated phenol formaldehyde resin of the formula:

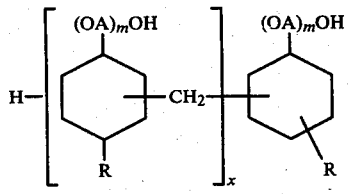

wherein A represents an alkylene group containing from about 2 to about 10 carbon atoms, where m has an average value of from about 4 to about 200, and where R is an alkyl group of about from 1 to about 20 carbon atoms, and x is an integer greater than 1, (III) from about 40 to about 70 weight percent of a mononuclear or dinuclear aromatic hydrocarbon solvent, and (IV) from about 5.0 to about 15.0 weight percent of a corrosion inhibitor selected from a hydrocarbyl succinic acid or anhydride having from 12 to 30 carbon atoms (50% oil).

2. The fuel of claim 1 wherein said ethanol is anhydrous or substantially anhydrous ethanol.

3. The fuel of claim 1 wherein said ethanol is hydrous ethanol.

4. The fuel of claim 3 wherein said ethanol contains up to about 25 volume percent water.

5. The fuel of claim 1 wherein said hydrocarbyl succinic acid or anhydride is tetrapropenyl succinic acid or anhydride.

6. The fuel of claim 1 comprising from about 70 to about 90 volume percent gasoline, from about 5 to about 30 volume percent hydrous ethanol and about 1.0 to about 100 ppm of said detergent additive.

* * * * *

UNITED STATES PATENT AND TRADEMARK OFFICE

CERTIFICATE OF CORRECTION

PATENT NO. : 4,398,921

DATED : AUGUST 16, 1983

INVENTOR(S) : ELLIS B. RIFKIN, MARTIN E. GLUCKSTEIN, WARREN L. PERILSTEIN

It is certified that error appears in the above-identified patent and that said Letters Patent is hereby corrected as shown below:

Column 2, line 2, reads "H—N>", and should read -- H—N< --.

Column 5, line 67, reads "H—N>", and should read -- H—N< --.

Column 9, line 30, reads "H—N>", and should read -- H—N< --.

Column 10, line 13, reads "—O—A)$_x$", and should read -- —(O—A)$_x$— --.

Signed and Sealed this

Third Day of July 1984

[SEAL]

*Attest:*

GERALD J. MOSSINGHOFF

*Attesting Officer*

*Commissioner of Patents and Trademarks*